US006151948A

United States Patent [19]

Ashworth et al.

[11] Patent Number: 6,151,948

[45] Date of Patent: Nov. 28, 2000

[54] METHODS AND APPARATUSES FOR PRODUCING COMPLEX-SHAPED METAL PARTS BY FORGING

[75] Inventors: Martin J. Ashworth, Auburn Hills; James Webster, Pleasant Ridge; John P. Dancoe, Oxford, all of Mich.

[73] Assignee: MSP Industries Corporation, Oxford, Mich.

[21] Appl. No.: 09/257,919

[22] Filed: Feb. 26, 1999

[51] Int. Cl.[7] ..... B21J 13/02

[52] U.S. Cl. ..... 72/359; 72/377

[58] Field of Search ..... 72/355.6, 358, 72/359, 377

[56] References Cited

U.S. PATENT DOCUMENTS

| | | | |
|---|---|---|---|
| 2,814,101 | 11/1957 | Prough et al. | 72/359 |
| 3,691,804 | 9/1972 | Clendenin et al. | 72/358 |
| 4,222,260 | 9/1980 | McDermott . | |
| 4,377,085 | 3/1983 | McDermott et al. | 72/359 |
| 4,426,872 | 1/1984 | Gatny . | |

OTHER PUBLICATIONS

"Summit racing Equipment" Catalog, Feb. 1998, pp. 43–45.
"Jeg's" Catalog, vol. K, Feb. 1998, p. 67–K.

*Primary Examiner*—Lowell A. Larson
*Attorney, Agent, or Firm*—Oliff & Berridge, PLC

[57] ABSTRACT

Methods and apparatuses for near net warm forging relatively small, complex shaped parts, such as automotive rocker arms, is disclosed. Die and punches are provided, which collectively have surfaces corresponding to the surfaces of the as-forged parts. Centralized workpieces, e.g., a transverse cylinders having a length-to-diameter ratio of approximately 1:1, are placed in cavities of the dies, and the punches are cycled through forging strokes to form the as-forged parts. The as-forged parts may have draft angles of 0–2° and surface-to-surface transitions with radii of less than or equal to about 1mm, and may also have substantially parallel side surfaces.

52 Claims, 8 Drawing Sheets

METHODS AND APPARATUSES FOR PRODUCING COMPLEX-SHAPED METAL PARTS BY FORGING

BACKGROUND OF THE INVENTION

1. Field of Invention

This invention is directed to the field of metal forging and, more particularly, to methods and apparatuses for near net warm forging relatively small, complex-shaped parts.

2. Description of Related Art

Many relatively small, complex metal parts, such as automotive rocker arms, are presently primarily formed and manufactured by stamping. For complex shaped parts, this stamping process requires several mechanical operations or steps to produce a single part, and results in parts with large radii at angular surface transitions (such as vertical-to-horizontal) due to the inability of metal stamping equipment and processes to form sharp angles at surface transitions. Further, certain part shapes cannot be formed by stamping.

Another known method of forming and manufacturing such relatively small, complex metal parts is investment casting. While parts made by investment casting may have more precise transitions between surfaces (i.e., smaller radii at surface transitions), such parts cannot be as efficiently mass produced by investment casting. Further, it has been attempted to manufacture such relatively small, complex metal parts by sand casting, but with little success.

In addition, certain relatively small, complex metal parts can also be machined from stock material. However, this manufacturing process cannot be used to efficiently mass produce such parts, as at least several complex machining operations or steps are required to produce a part. Thus, this method is typically used only to produce high-performance specialty parts such as specialty rocker arms made, for example, of special lightweight alloys.

Hot forging methods and apparatuses have also been used to produce such relatively small, complex parts. Forging offers certain advantages over casting. For example, a forged part is usually "stronger" than a casted part, because the forged part has reduced porosity and a more refined internal structure. However, hot forging methods and apparatuses have certain disadvantages, as follows. First, parts made by hot forging must have draft angles on all vertical surfaces to facilitate removal of the parts from the molds after forging. The formation of these draft angles requires excess material to form the parts, unnecessarily increasing the cost of the parts and overall mass of the engine's valve train. Second, during hot forging, flash (or excess material) is formed between die segments, forming rough edges that must be subsequently machined. These subsequent machining operations increase the cost of the parts.

Thus, while hot forging methods and apparatuses can be employed to mass produce certain relatively small, complex metal parts, the cost of producing such parts by these methods and apparatuses is relatively high due to these disadvantages. Cost is very important in producing certain mass-produced, relatively small, complex metal parts, such as automotive rocker arms. Any cost saving or reduction is important, even if minimal, because of the volume of the parts which are usually produced by a manufacturer.

Accordingly, there is a general need for methods and apparatuses that can efficiently produce relatively small, complex shaped parts such as automotive rocker arms, and which are cost effective. This general need includes a specific need for methods and apparatuses that produce such relatively small, complex shaped parts in one or a small number of mechanical steps and which produce parts that do not require extensive machining. Further, there is a need for methods and apparatuses which produce such parts wherein the completed parts have finely machined surfaces and small radii between surface transitions.

It is an object of the present invention to provide such methods and apparatuses. It is another object of the invention to provide methods and apparatuses which can produce complex parts such as automotive rocker arms with substantially no waste of material.

SUMMARY OF THE INVENTION

This invention provides segmented die sets and punches which form cavities with surfaces corresponding in shape to the surfaces of relatively small, complex shaped metal parts, such as automotive rocker arms. The invention also provides methods of using these die sets and punches to form or manufacture the parts.

This invention has particular utility in manufacturing parts having elongated members extending from a base member, because the segmented die members can be designed such that the side surfaces of the cavity have a very small draft angle (and thus the resulting side surfaces of the part will have a very small draft angle) and such that the resulting surface transitions have very small radii, or are substantially right-angular.

Workpieces (also called billets or blanks) are heated to the desired temperature and placed in the die sets. The punches are then cycled through forging strokes, thereby forming the workpieces into the desired parts. In certain embodiments, the workpiece material flows upward, downward and laterally during the forging process. The vertical movement of material of the workpiece in the cavity, both in the upward and downward directions, is preferably approximately equal to the lateral movement of the material of the workpiece. Thus, the workpiece material reaches all distal surfaces of the cavity at substantially the same time.

Each workpiece has a volume substantially equal to the volume of the as-forged part. This eliminates the problem of flash, and the workpiece material is efficiently utilized. Furthermore, since the parts are warm forged, they are superior to cast parts in mechanical properties and soundness due to the way individual grains deform during forging and immediately begin to recrystallize and nucleate stress-free equiaxed grains, resulting in a fine-grained structure.

Warm forgings are not affected by common casting defects such as macro and micro shrinkage porosity, dendritic structure, spikes, blow holes, and refractory and sand inclusions, which affect the soundness of parts and lead to premature failure during tensile testing, fatigue testing or service.

BRIEF DESCRIPTION OF THE DRAWINGS

Certain preferred embodiments of this invention will be described in detail, with reference to the following figures, in which.

DETAILED DESCRIPTION OF THE INVENTION

This invention is directed to punch and die combinations that can be used in conventional forging presses to produce relatively small, complex shaped metal parts, such as automotive rocker arms, by near net warm forging. This invention also provides methods of using these combinations to form the desired metal parts.

Figure 1:
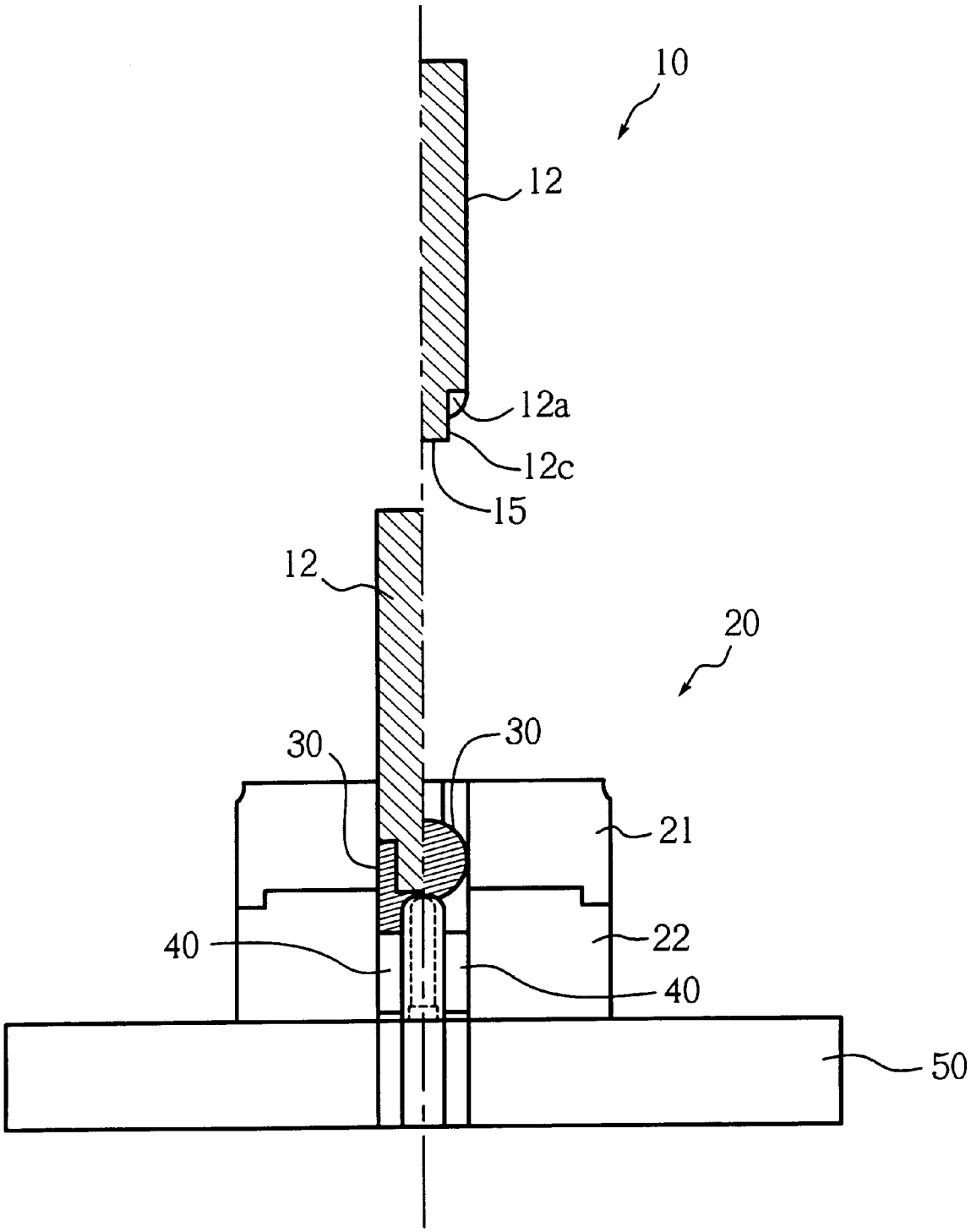
FIG. 1 is a sectional view of a punch and die set of one embodiment of the present invention, illustrating the punch in the down position on the left side and in the up position on the right side.

FIG. 1 illustrates one embodiment of this invention, a forging apparatus 10 comprising a forging punch 12 that is reciprocatable into and away from a die set 20. The left side of FIG. 1 shows the punch 12 in the down position with respect to the die set 20, while the right side of FIG. 1 shows the punch 12 in the up position. When the punch 12 is in the down position, the punch and die form a closed die cavity. A workpiece 30, shown in the right side of the figure, is forged into a rocker arm 30' within the die cavity, as shown in the left side of the figure, by forging apparatus 10.

As stated, the punch and die combinations of this invention can be used to warm forge metal parts. Typically, warm forging processes utilizing these combinations are conducted at a temperature range of from about 1200° F. to about 2200° F. The optimum warm forging temperature range to produce a given part is dependent on various factors, including the workpiece material and shape, the part configuration, the configuration and composition of the die cavity, etc. For example, the automotive rocker arm 30' has been warm forged, using the punch 12, the die set 20 and a workpiece 30 (see FIGS. 2A and 2B) of 1018 or 1050 steel, at a temperature range of from about 1800° F. to about 1900° F.

FIGS. 15–18 illustrate the automotive rocker arm, rocker arm 30', that is produced by forging apparatus 10. The rocker arm 30' is symmetrical about a longitudinal plane 16—16 and includes a base member 31, top side members 32, and bottom side members 33. The top side members 32 extend upwardly from the base member 31 and the bottom side members 33 extend downwardly from the base member 31.

The base member 31 includes a hemispherical concave recess 34, a top surface 35, a contact pad 36, a bottom surface 38, and transition portions 35*a*, 38*a* and 38*b*, and is tapered inwardly at each end thereof (when viewed from the top). See FIGS. 15 and 16. The hemispherical concave recess 34 is provided at one end of the bottom surface 38 for receiving and engaging an end of a push rod (not shown). The contact pad 36 is provided at another end of the bottom surface 38 for contacting an end of a valve stem (not shown). The contact pad 36 may be of any desired shape and thickness. In this embodiment of the invention, the contact pad 36 is slightly curved when viewed from the side (see FIG. 16). In some embodiments of this invention, the contact pad 36 can be omitted, i.e., in some embodiments the rocker arm will not include a contact pad.

The base member 31 has a stepped planar configuration when viewed from the side (see FIG. 16), with the transition portion 35*a* between different elevations of the top surface 35 of the base member 31, and transition portions 38*a* and 38*b* between different elevations of the bottom surface 38. In other embodiments, the base member 31 may have a completely planar configuration or a slightly curved configuration, or any other desired configuration (when viewed from the side). The configuration of the base member 31 is designed such that (1) the hemispherical concave recess 34 engages the push rod and the contact pad 36 engages the valve stem of the cylinder head with which the rocker arm 30' is to be used and (2) the mass of rocker arm 30' is as optimally distributed as possible. It is preferable for the base member 31 to be as thin as practically possible, because the thickness of the base member 31 does not add significantly to the rigidity of the rocker arm 30'.

As stated, top side members 32 extend upwardly from the top of the base member 31. See FIGS. 16 and 17. The top side members 32 extend substantially the length of the base member 31 and are defined by top edge surfaces 32*a* (which are continuously curved and taper to a height of zero near the respective ends of the base member 31 in this embodiment), outer side surfaces 32*b* and top inner side surfaces 32*c*. When viewed from the top (see FIG. 15), the top side members 32 angle in toward the longitudinal center plane of the rocker arm 30', following the tapers of the base member 31. In the embodiment illustrated in FIGS. 15–18, the top side members 32 have a maximum height $h_{1max}$ and a thickness $t_1$.

Also as stated, bottom side members 33 extend downwardly from the bottom of the base member 31. See FIGS. 16 and 17. The bottom side members 33 are defined by bottom edge surfaces 33*a* (which are continuously curved and taper to a height of zero at their respective ends in this embodiment), outer side surfaces 32*b* and bottom inner side surfaces 33*c*. In the embodiment illustrated in FIGS. 15–18, the bottom side members 33 have a maximum height $h_{2max}$ and a thickness $t_2$.

It is noted that, while the top side members 32 and the bottom side members 33 of this embodiment are continuously curved, this invention is not limited to top and bottom side members having this configuration. Rather, the top and bottom side members may be of any feasible configuration (when viewed from the side). For example, the members 32 and/or 33 may be rectangular, having a constant height, stepped in a staircase configuration, or formed by a series of straight and/or curved line segments, as desired. The tapered configuration of the embodiment illustrated in the Figures is generally considered to be advantageous for automotive rocker arms, as it provides rigidity and strength to the rocker arms without having excess material at the ends of the rocker arms. This design reduces the moment created when the rocker arms rock back and forth, thereby avoiding unnecessary diminishing of the available horsepower of an engine.

Top inner side surfaces 32*c* of the top side members 32 and bottom inner side surfaces 33*c* of the bottom side members 33 are substantially parallel to outer side surfaces 32*b* of the rocker arm 30'. Stated differently, surfaces 32*b*, 32*c* and 33*c* have very small draft angles, if any.

Figure 17:
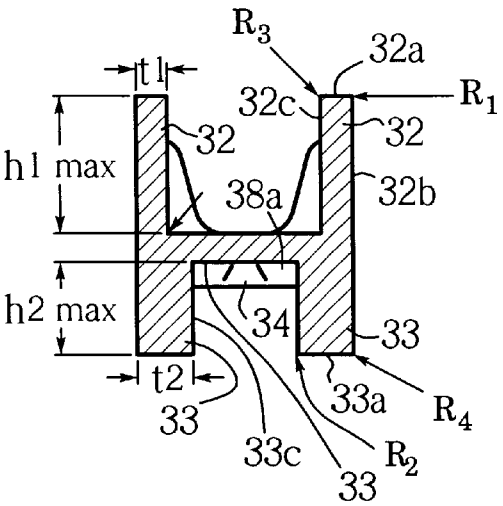
FIG. 17 is a cross-sectional view along line 17—17 of FIG. 15.
Figure 18:
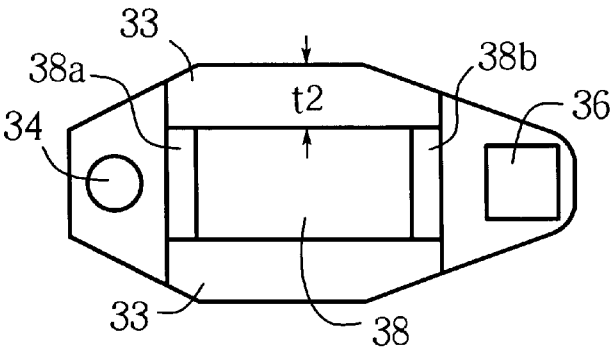
FIG. 18 is a bottom view of the rocker arm shown in FIGS. 15–17.

Furthermore, the surface transitions between (1) the top edge surfaces 32*a* and the outer side surfaces 32*b* and (2) the bottom edge surfaces 33*a* and the bottom inner side surfaces 33*c* may have extremely small radii $r_1$ and $r_2$, respectively (see FIG. 17). For example, the radii $r_1$ and $r_2$ may be on the order of about 0 to about 1 mm, where a radius of 0 indicates a substantially right-angle transition. Surface transitions between (1) the top surface 35 of base member 31 and top inner side surfaces 32*c*, (2) the bottom surface 38 and bottom inner side surfaces 33*c*, (3) the top inner side surfaces 32*c* and the top edge surfaces 32*a* and (4) the bottom edge surfaces 33*a* and the outer side surfaces 32*b* may have radii $R_1$, $R_2$, $R_3$ and $R_4$, respectively, on the order of about 1 mm to about 2 mm.

Figure 11:
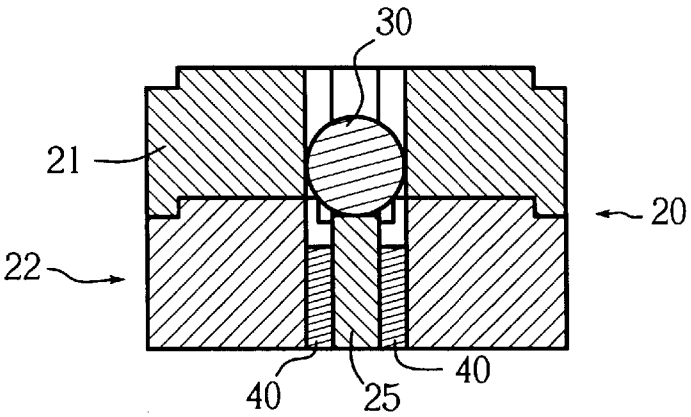
FIG. 11 is a cross-sectional view along line 11—11 of FIG. 10.
Figure 12:
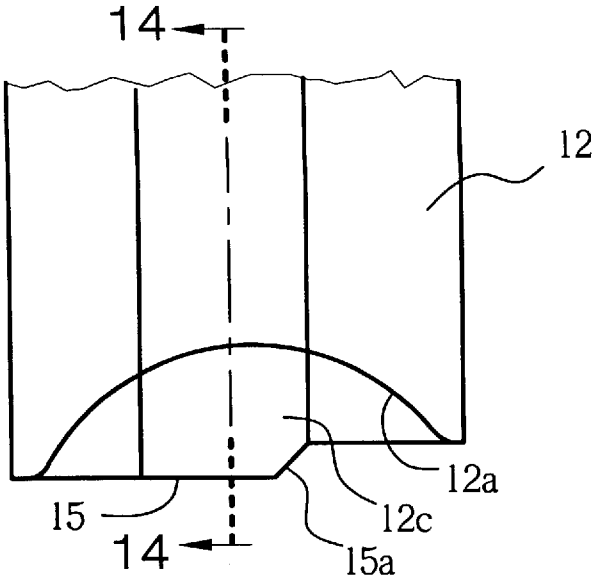
FIG. 12 is a side view of a punch of one embodiment of this invention.

The top side members 32 and the bottom side members 33 of the rocker arm 30' have relatively small widths $t_1$ and $t_2$ compared to their maximum heights $h_{1max}$ and $h_{2max}$, respectively, as shown in FIGS. 11 and 12. This invention has particular utility in the warm forging of parts having members which extend from a central portion a distance greater than the width of the member. In fact, in this embodiment, the top side members 32 have a width-to-maximum height ratio of about 1:6 and the bottom side members 33 have a width-to-maximum height ratio of about 1:1.5. Parts having top and/or bottom members having width-to-maximum height ratios of lower than 1:6, such as 1:10, can also be effectively and efficiently produced by methods and apparatuses according to this invention. This invention encompasses any such ratio that may be achieved using the methods and apparatuses of this invention.

The die set 20 will next be described, with reference to FIGS. 1 and 3–11. The die set 20 comprises an upper die 21, a lower die 22 and a base 50. The upper die 21 may be nested on and secured to the lower die 22 by a conventional retaining mechanism (not shown). The nested dies may be placed on and secured to the base 50 (see FIG. 1).

Figure 3:
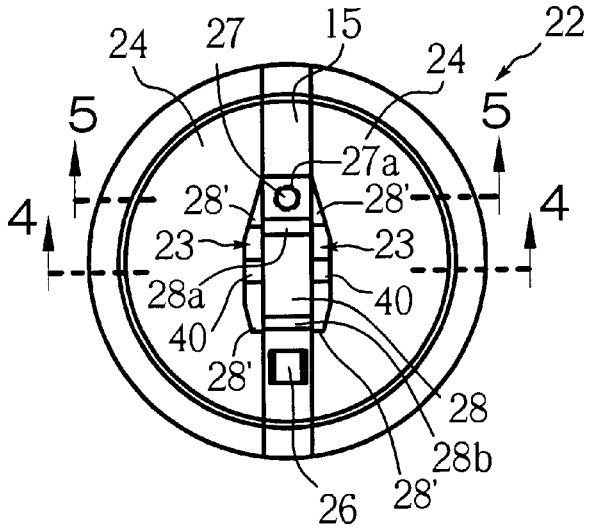
FIG. 3 is a top view of a lower die of one embodiment of this invention.
Figure 4:
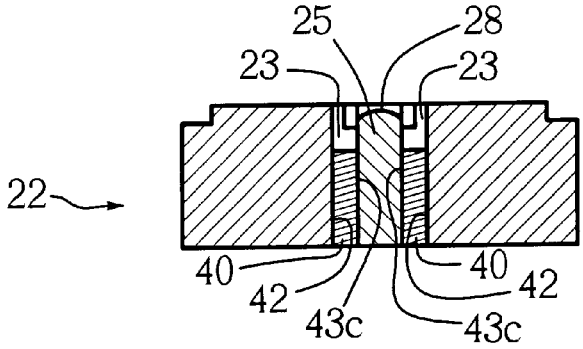
FIG. 4 is a cross-sectional view along line 4—4 of FIG. 3.
Figure 5:
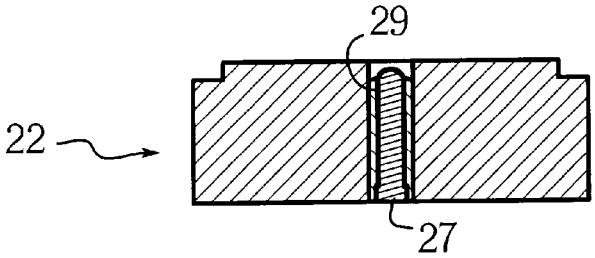
FIG. 5 is a cross-sectional view along line 5—5 of FIG. 3.
Figure 6:
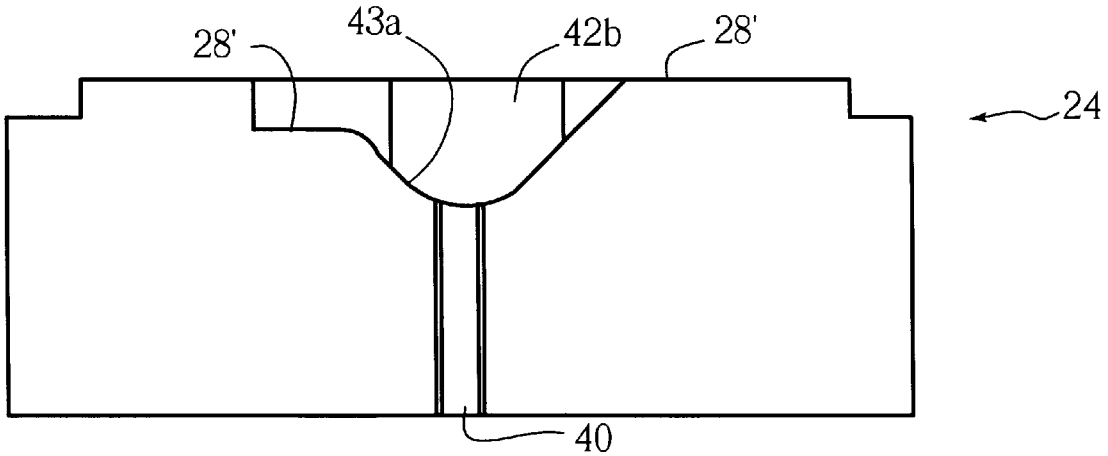
FIG. 6 is a side view of the outer die segment of the embodiment illustrated in FIG. 3.
Figure 7:
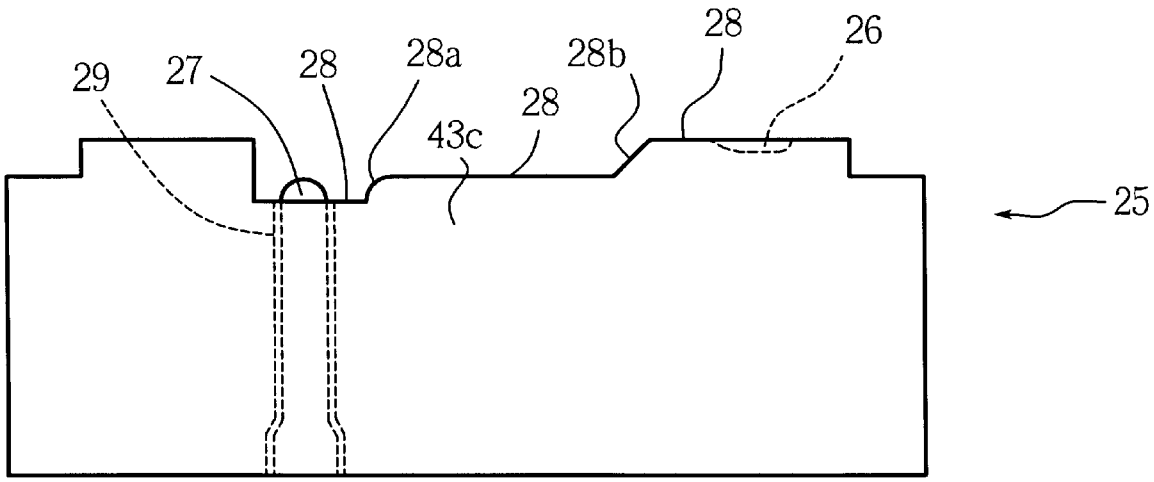
FIG. 7 is a side view of the center die segment of the embodiment illustrated in FIG. 3.
Figure 8:
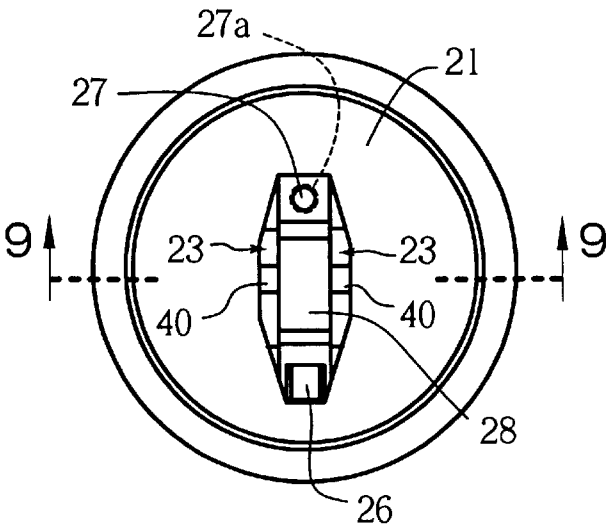
FIG. 8 is a top view of an assembled die set of one embodiment of this invention.
Figure 10:
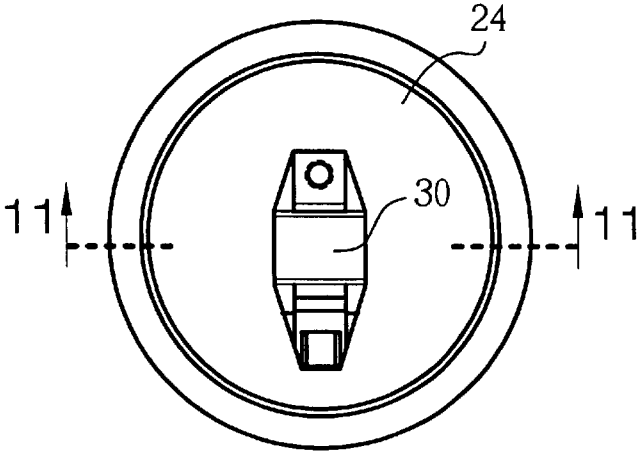
FIG. 10 is a top view of the assembled die set of FIG. 8 with a workpiece positioned therein.

As shown in FIGS. 3, 6 and 7, the lower die 22 includes two outer die segments 24 and a center die segment 25. In this embodiment, the two outer die segments 24 are mirror images of each other, and are positioned on opposite sides of the center die segment 25.

The outer die segments 24 have cavity-defining surfaces 28', 42*b* and 43*a*. See FIGS. 3 and 6. Surfaces 28' each correspond to a portion of the bottom surface 38 of the rocker arm 30'. Surfaces 42*b* correspond to the lower portions of outer side surfaces 32*b* of the rocker arm 30'. Surfaces 43*a* correspond to bottom edge surfaces 33*a* of the rocker arm 30'. The outer die segments 24 also have vertical holes 42 (see FIG. 4) formed therein which are sized and shaped to slidingly accommodate the ejector pins 40 (discussed below).

The ejector pins 40 are reciprocatable within the holes 42 in the outer die segment 24. As illustrated in FIG. 6, the top surfaces of the ejector pins 40 of this embodiment respectively form portions of cavity-defining surfaces 43*a* when the pins 40 are in a retracted position. In other words, the top surfaces of the ejector pins 40 are aligned with cavity-defining surfaces 43*a* when the ejector pins 40 are in a retracted, or non-actuated, position. In other embodiments, the ejector pins may be located such that their top surfaces form portions of other cavity-defining surfaces. For example, at least one ejector pin may be located such that its top surface forms a portion of the top surface 28 of the center die segment 25 (discussed below).

After being forged, the rocker arm 30' is ejected from the die set 20 by ejector pins 40. The ejector pins 40 may be actuated automatically or manually by any suitable mechanism.

Figure 13:
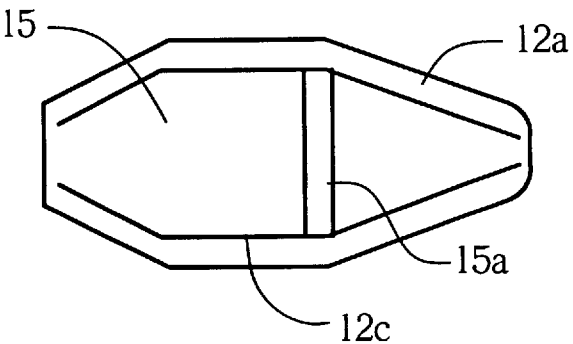
FIG. 13 is a bottom view of the punch of FIG. 12.

The center die segment 25 has a pin 27, a vertical bore 29, a concave indented portion 26, a top surface 28, and side surfaces 43*c*. See FIGS. 3 and 7. The top surface 28 corresponds in shape to the shape of the bottom surface 38 of the rocker arm 30' (see FIGS. 11 and 13). The pin 27 is positioned within the vertical bore 29 (see FIG. 5). The distal end of the pin 27 is dome-shaped, having a shape that corresponds to the desired shape of the hemispherical concave recess 34 of the rocker arm 30'. The concave indented portion 26 corresponds in shape and position to the desired shape and position of the contact pad 36 of the rocker arm 30'. Portions 28*a* and 28*b* of the surface 28 of die segment 25 correspond in shape and position to transition portions 38*a* and 38*b*, respectively, of the bottom surface 38 of the rocker arm 30'. Side surfaces 43*c* of center die segment 25 correspond to bottom inner side surfaces 33*c* of bottom side members 33.

When the outer die segments 24 and the center die segment 25 are mated together as illustrated in FIG. 3, the cavity-defining surfaces 42*b* and 43*a* of the outer side segments 24 and the side surfaces 42*c* of the center die segment 25 define cavity portions 23. The cavity portions 23 correspond in shape and size to the shape and size of the bottom side members 33 of the rocker arm 30'. Furthermore, cavity-defining surfaces 28' of the outer die segments 24 are substantially coplanar with respective portions of the top surface 28 of the center die segment 25 (see FIGS. 3 and 6–7).

The assembled lower die 22 has a substantially circular perimeter when viewed from the top, as in FIG. 3. Because of the segmented configuration in which the two outer die segments 24 are positioned on opposite sides of the center die segment 25, the outer die segments 24 can be machined from a single piece of circular stock material. Specifically, when a cylindrical piece of stock material is divided, a saw kerf or the like is formed that takes away material from between the two resulting halves of the stock material. If these two "halves" are put back together, the resulting shape is no longer circular in cross section due to the reduced material in the center. However, when a third segment, such as center die segment 25, is positioned between the "halves", the center segment 25 essentially compensates for the saw kerf, and the "halves" no longer need to be perfectly semi-circular to form a circle in cross section. Thus, even when a cylindrical, pre-machined blank is divided to form the outer die segments 24, the desired circular cross section can be achieved by combining the center die segment 25 with the outer die segments 24. Therefore, the material used to form the dies is efficiently utilized.

Figure 9:
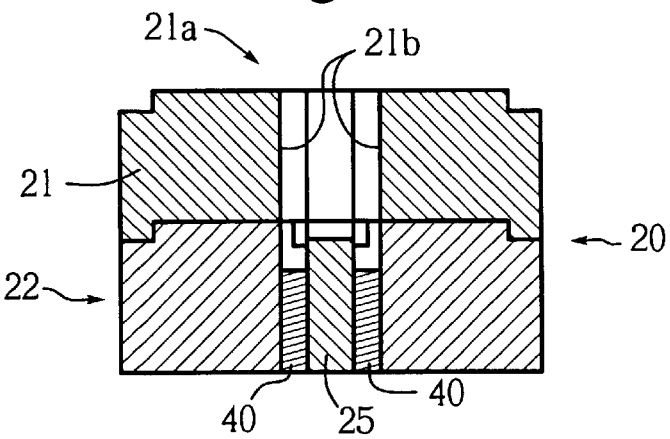
FIG. 9 is a cross-sectional view along line 9—9 of FIG. 8, showing an upper die positioned on top of a lower die.

As stated and as illustrated in FIG. 9, the upper die 21 is placed on top of the lower die 22, and the two dies are secured together in a known manner. The upper die 21 has a cut-out 21*a* that is the shape of the perimeter of rocker arm 30' (when viewed from the top) and includes surfaces 21*b* that correspond to the upper portion of outer side surfaces 32*b* of the rocker arm 30'. The surfaces 21*b* of the upper die 21 are substantially coplanar with the surfaces 42*b* of the lower die 22 when dies 21 and 22 are assembled.

The punch 12 will next be described, with reference to FIGS. 1 and 12–14. Punch 12 includes forming surfaces 12*a*, 12*c*, 15 and 15*a*. Forming surfaces 12*a* correspond in shape and size to the shape and size of top edge surfaces 32*a* of top side members 32 of the rocker arm 30' (see FIGS. 11–12). Forming surfaces 12*c* correspond in shape and size to the shape and size of top inner side surfaces 32*c* of the rocker arm 30'. Forming surface 15 corresponds in shape and size to the shape and size of top surface 35 of the rocker arm 30'. Forming surface 15*a* corresponds in shape and size to the shape and size of the transition portion 35*a* of the top surface 35 of the rocker arm 30'.

Figure 2A:
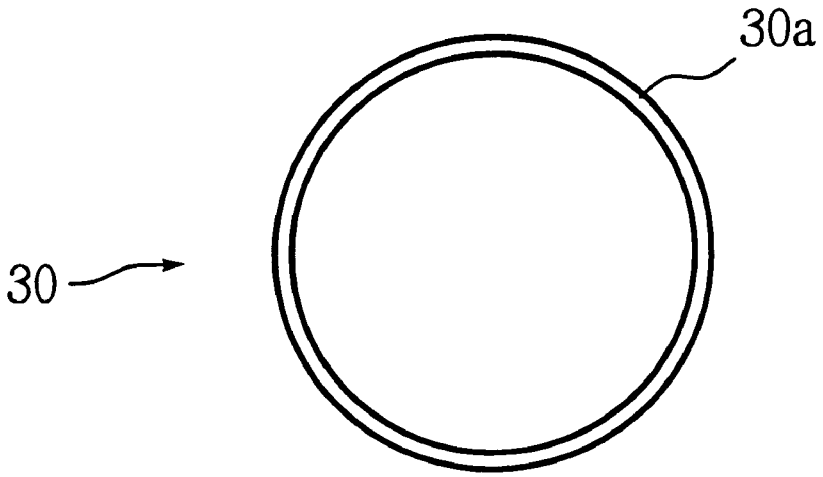
FIG. 2A is a front view of a workpiece which can be formed into an automotive rocker arm as illustrated by FIGS. 10–14 if inserted into the embodiment of this invention illustrated in FIGS. 1 and 3–9 and the embodiment completes a forging cycle.
Figure 2B:
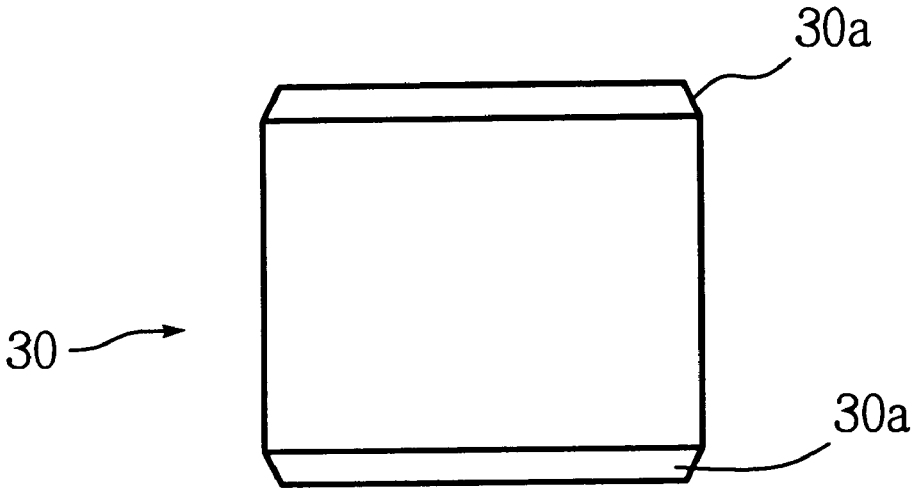
FIG. 2B is a top view of the workpiece illustrated in FIG. 2A.

A workpiece which can be inserted in forging apparatus 10 to produce rocker arm 30', workpiece 30, is illustrated in FIGS. 2A and 2B. The workpiece 30 is generally cylindrically shaped, having a length-to-diameter ratio in a range of from about 1:0.5 to about 1:1.5, and preferably, of approximately 1:1. Intuitively, one might expect that, given the shape of the rocker arm 30', an elongated or bullet-shaped workpiece should be used in forging apparatus 10 to produce rocker arm 30'. However, rocker arm 30' can be more effectively and efficiently produced from a workpiece having a centralized mass, such as workpiece 30, for the following reason.

In warm forging, when the cavity of the die has a portion which is relatively elongated at the center of the die, it is important for the workpiece to have a large mass near its center portion so that vertical movement of the workpiece material (possibly in both the up and down directions) is approximately equal to horizontal movement of the workpiece material.

Stated differently, it is desirable that all distal surfaces of the die cavity, including the end surfaces of any relatively long, narrow portions of the cavity, are contacted by the workpiece material at substantially the same time during the forging stroke. This prevents rollover and other forging phenomena from occurring which may cause imperfections in the finished parts. When a die cavity has centralized elongated portions, such as the die cavity in die set 20, the use of a workpiece having a centralized mass results in the workpiece material reaching the distal surfaces of all of the cavity portions substantially simultaneously. The workpieces may also be of other shapes having a large mass near the center portion, such as a generally cubic shape or a generally spherical shape.

Of course, for certain other part configurations, and thus other cavity configurations, axi-symmetrical workpieces, such as cylindrical workpieces, may be the optimally shaped workpieces to effectively and efficiently produce the desired part configuration.

As stated, the volume of the workpiece 30 is substantially equal to the volume of the as-forged rocker arm 30'. This is accomplished by selecting a workpiece having the appropriate height and diameter. The volume of the workpiece may be optimized by adjustment of the geometry at the design stage. For example, as shown in FIGS. 2A and 2B, an optimized volume is achieved with formed bevel surfaces 30*a* on the ends of the workpiece 30.

A rocker arm 30' is produced from a workpiece 30 utilizing forging apparatus 10, as follows. The workpiece 30 is heated to the desired temperature range, lubricated (if desired or necessary) and inserted into the cavity of die set 20. When the workpiece 30 is placed in the die set 20, the longitudinal axis of the workpiece 30 is aligned with the longitudinal axis of the die set. See FIG. 8. Alternatively, the workpiece 30 may be placed at any other orientation, such as with its longitudinal axis aligned with a lateral axis or a vertical axis of the die set. The punch 12 then conducts a forging stroke, impacting and deforming the workpiece 30 into the configuration defined by the die cavity walls and forming surfaces of the punch 12, which is the configuration of the rocker arm 30'.

Specifically, the punch 12 is lowered to its lowermost position, as illustrated on the left side of FIG. 1. When the punch reaches its lowermost position, a die cavity is formed by the punch and die surfaces described above. During this downward movement of the punch, the workpiece material completely fills the die cavity, flowing in the upward, downward, and lateral directions. In this regard, workpiece material fills the die cavity such that the cavity surfaces located the furthest from the center of the cavity are contacted by workpiece material at substantially the same time. In particular, the workpiece material flows downward and laterally to fill the cavity portions 23 defined by cavity-defining surfaces 43*a* and side surfaces 42*b* of outer die segments 24 and side walls 43*c* of center die segment 25, upward and laterally to fill the cavity portions defined by forming surfaces 12*a* and 12*c* of punch 12 and surfaces 21*b* of upper die 21, and laterally to fill the cavity portions between surface 28 of center die segment 25 and forming surface 15 of punch 12.

While the punch 12 is in its lowermost position, the pin 27 (see FIG. 5) is located in a fixed position within the bore 29 to form the concave recess 34 in the bottom surface 38 of the rocker arm 30'. The pin 27 is fixed at the appropriate forming depth by the base 50, which sits below the pin 27.

The punch 12 is then retracted into its raised position and the ejector pins 40 are actuated, forcing the as-forged rocker arm 30' out of the die cavity. The as-forged rocker arm 30' has the above-described configuration.

Since the volume of the workpiece 30 is substantially equal to the volume of the as-forged rocker arm 30', the problem of flash is substantially eliminated. The as-forged parts may have very small amounts of flash which may be easily removed by, for example, placing a plurality of as-forged parts in a tumbling machine and tumbling them until the desired smoothness is achieved.

Figure 14:
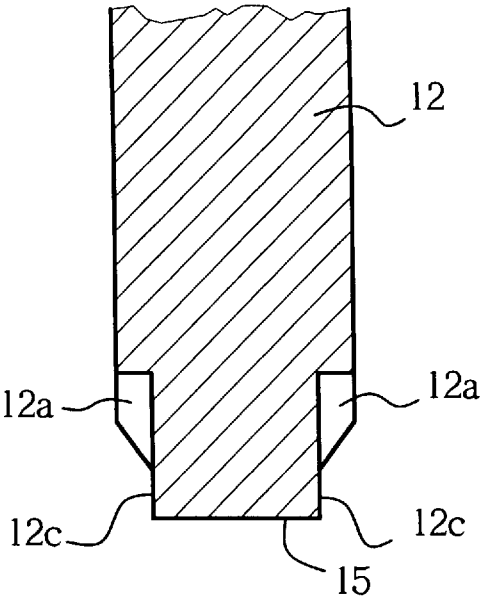
FIG. 14 is a cross-sectional view along line 14—14 of FIG. 12.
Figure 15:
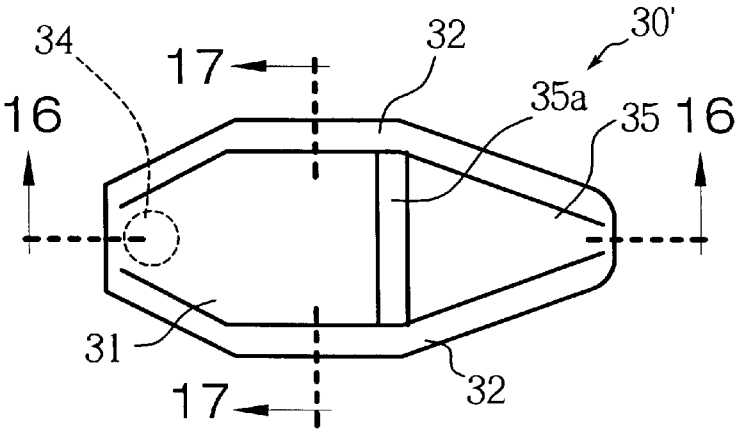
FIG. 15 is a top view of an as-forged rocker arm which can be produced using the die set of FIGS. 1 and 3–11 and the punch of FIGS. 1 and 12–14.
Figure 16:
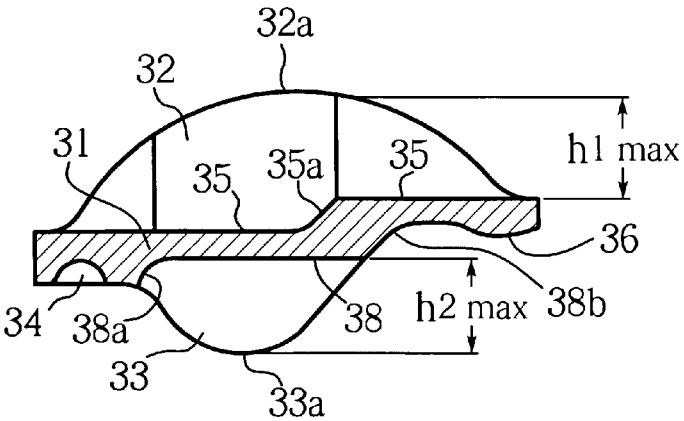
FIG. 16 is a cross-sectional view along line 16—16 of FIG. 15.
Figure 21:
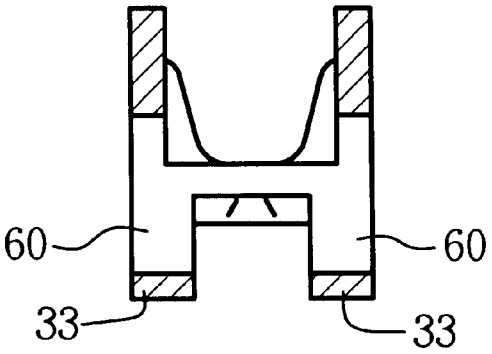
FIG. 21 is a cross-sectional view along line 21—21 of FIG. 19.
Figure 19:
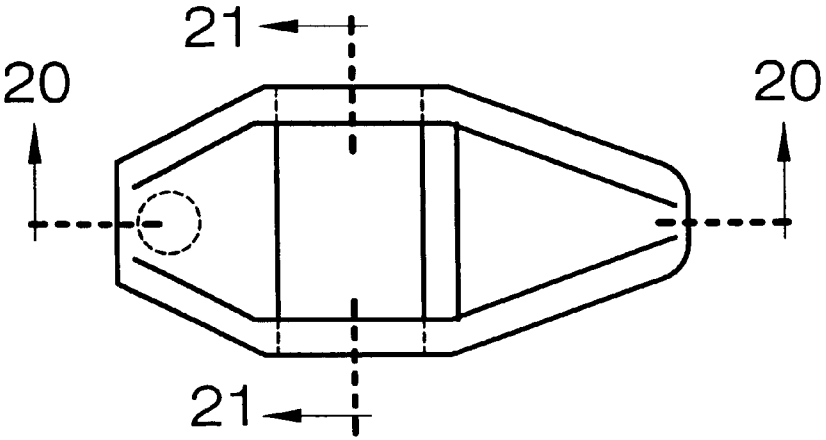
FIG. 19 is a top view of a finished rocker arm which can be produced using the die set of FIGS. 1 and 3–11, the punch of FIGS. 1 and 12–14, and a known boring apparatus.
Figure 20:
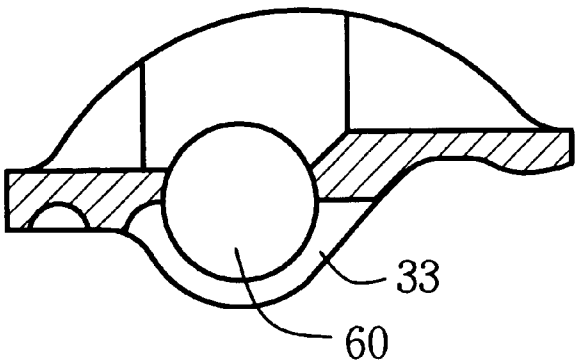
FIG. 20 is a cross-sectional view along line 20—20 of FIG. 19.

The as-forged rocker arms 30' can be further processed if desired or necessary to produce finished rocker arms. For example, as shown in FIGS. 14 and 15, holes 60 may be bored in the bottom side members 33 for receiving a member (not shown) that attaches the rocker arms 30' to the cylinder head of an engine. If necessary, the concave recess 34 and/or the contact pad 36 may be subjected to final processing, such as finish grinding or polishing. These and/or other processes may, for example, be accomplished using an index machine which rotates the parts to different processing stations.

Thus, as stated, the methods and apparatuses of this invention can efficiently produce complex-shaped parts, such as forged rocker arms 30', by near net warm forging. This invention is particularly useful in producing parts having members with relatively large heights or other elongated portions because of the features described above. The methods and apparatuses of this invention allow adequate flow of the workpiece material in all directions, including the upward direction, so that the flowing workpiece material properly fills the entire die cavity (including relatively elongated, narrow spaces) and contacts all of the distal cavity surfaces at substantially the same time.

Further, use of a segmented lower die set allows mating dies to have finely machined surfaces and sharp corners, thereby allowing the as-forged parts to have small radii at surface transitions, and parallel inner and outer side surfaces. Unlike other forging processes and methods, substantially no draft angles are required to facilitate removal of the as-forged parts from the die set. Therefore, workpiece material is efficiently utilized.

While the invention has been described in conjunction with the specific embodiments described above, many alternatives, modifications and variations will become apparent to those skilled in the art once given this disclosure. Accordingly, the preferred embodiments of the invention as set forth above are considered to be illustrative and not limiting. Various changes to the described embodiments may be made without departing from the spirit and scope of the invention.

What is claimed is:

1. A method of near net warm forging a metal part comprising a base member having a top surface and a bottom surface, at least one top member extending from the top surface of the base member and at least one bottom member extending from the bottom surface of the base member, the method comprising the steps of:

providing a segmented die and a punch comprising surfaces which form a cavity, when the punch is in a first position, corresponding in shape to the base member, the top member and the bottom member, wherein the segmented die and punch are designed and positioned such that the bottom member is formed by at least two segments of the die, and the surfaces of the die segments which form the side surfaces of the bottom member have a draft angle of less than 2°;

placing a workpiece in the die set; and cycling the punch through a forging stroke to forge the metal part from the workpiece.

2. The method of claim 1, wherein the die set further comprises at least one ejector pin slidably received in the segmented die, the method further comprising the step of actuating the at least one ejector pin to eject the unitary part.

3. The method of claim 1, wherein the workpiece has a substantially centralized mass.

4. The method of claim 1, wherein the workpiece is substantially cylindrical in shape, having a length-to-diameter ratio of from about 1:0.5 to about 1:1.5.

5. The method of claim 1, wherein the top member has side surfaces defined by the punch, and wherein the surfaces of the punch defining the side surfaces of the top member have a draft angle of less than 2°.

6. The method of claim 5, wherein the draft angles are substantially zero.

7. The method of claim 1, wherein, during the step of cycling the punch through the forging stroke, movement of material of the workpiece is such that all distal cavity surfaces are contacted by workpiece material at substantially the same time.

8. The method of claim 7, wherein, during the step of cycling the punch through the forging stroke, workpiece material flows in upward, downward, and lateral directions.

9. The method of claim 1, wherein the workpiece has a volume substantially equal to a volume of the metal part.

10. The method of claim 1, wherein at least one of the top side members and at least one of the bottom side members have width-to-maximum-height ratios in a range of from about 1:1 to about 1:6.

11. The method of claim 1, wherein the at least one top member and the at least one bottom member each comprise an outer surface and an inner surface substantially parallel to the outer surface.

12. The method of claim 1, wherein a transition between the base member and the at least one top member and the at least one bottom member has a radius of less than or equal to about 1 mm.

13. The method of claim 1, wherein the segmented die comprises a first die segment and a second die segment substantially symmetrical to the first die segment.

14. The method of claim 13, wherein the segmented die further comprises a third die segment positioned between the first and second die segments.

15. The method of claim 1, wherein, prior to step of cycling the punch through a forging stroke, the temperature of the workpiece is made to be in a range of from about 1200° F. to about 2200° F.

16. The method of claim 1, wherein, prior to step of cycling the punch through a forging stroke, the temperature of the workpiece is made to be in a range of from about 1800° F. to about 1900° F.

17. A metal part forged according to the method of claim 1.

18. A forging apparatus for forging a metal part having (1) a base portion, (2) at least one upper portion extending upward from the base portion and having a maximum height and a width and (3) at least one lower portion extending downward from the base portion, and having a maximum height and a width, with at least one of the width-to-maximum-height ratio of the upper portion and the width-to-maximum height ratio of the lower portion being at least 1:4, the forging apparatus comprising:

a die set comprising:

first and second side surfaces forming outer sides of a cavity;

at least one inner lower side surface spaced apart from one of the first and second side surfaces, the at least one inner lower side surface forming at least one inner lower side of the cavity and having a length corresponding to a length of the at least one lower portion of the metal part; and at least one bottom edge surface extending between the bottom end of one of the first and second side surfaces and the at least one inner lower side surface;

a punch movable between a raised position and a lowered position with respect to the die set, the punch comprising:

at least one inner top surface oriented in a generally vertical direction, the length of the at least one inner top surface corresponding to the length of the at least one upper portion of the metal part;

at least one top edge surface extending from a top end of one of the at least one inner top surface in a direction away from a longitudinal center of the punch; and a main top surface extending from a bottom end of the at least one inner top surface in a direction opposite to the direction of the at least one top edge surface;

wherein, when the punch is at the lowered position, the at least one inner top surface forms an inner top side of the cavity, the at least one top edge surface forms a top edge of the cavity, and the main top surface forms a main top of the cavity.

19. The forging apparatus of claim 18, further comprising at least one ejector pin movable between a retracted position and an extended position, the at least one ejector pin comprising a top surface which, when the at least one ejector pin is in the retracted position, forms a portion of at least one of the surfaces defining the cavity.

20. The forging apparatus of claim 18, wherein the die set comprises a first die segment and a second die segment substantially symmetrical to the first die segment.

21. The forging apparatus of claim 20, wherein the die set further comprises a third die segment to be positioned between the first and second die segments.

22. The forging apparatus of claim 18, wherein at least one of the width-to-maximum-height ratio of the upper portion and the width-to-maximum height ratio of the lower portion is in a range of from at least 1:4 to about 1:10.

23. The forging apparatus of claim 18, wherein at least one of the width-to-maximum-height ratio of the upper portion and the width-to-maximum height ratio of the lower portion is in a range of from about 1:6 to about 1:10.

24. A forging apparatus for warm forging a relatively small, complex metal part comprising:

a die comprised of two or more segments and having a cavity; and a punch reciprocatably received by the die;

wherein at least two of the segments are designed and located such that the at least two segments form a first elongated cavity portion extending away from the center of the cavity in the die, the two segments forming opposing walls of the elongated cavity portion, wherein the opposing walls have a draft angle of less than 2°.

25. The forging apparatus as defined by claim 24, wherein the width-to-maximum height ratio of the first elongated cavity portion is in a range of from about 1:1 to about 1:6.

26. The forging apparatus as defined by claim 24, wherein when the punch is received by the die, the punch and die form a second elongated cavity portion extending away from the center of the cavity in the die.

27. The forging apparatus as defined by claim 26, wherein the second elongated cavity portion has a draft angle of less than 2°.

28. The forging apparatus as defined by claim 26, wherein the width-to-maximum height ratio of the second elongated cavity portion is in a range of from about 1:1 to about 1:6.

29. The forging apparatus as defined by claim 24, wherein surface-to-surface transitions between the first elongated cavity portion and adjoining portions of the cavity are less than or equal to about 1 mm.

30. A method of near net warm forging a metal part comprising a base member having a top surface and a bottom surface, at least one top member extending from the top surface of the base member and at least one bottom member extending from the bottom surface of the base member, the method comprising the steps of:

providing a segmented die and a punch comprising surfaces forming a cavity corresponding in shape to the top and bottom surfaces of the base member, the top member and the bottom member, wherein the segmented die and punch are designed and positioned such that the bottom member is formed by at least two segments of the die, and transitions between the cavity surfaces have radii less than or equal to about 1 mm;

placing a workpiece in the die set; and cycling the punch through a forging stroke to forge the metal part from the workpiece.

31. The method of claim 30, wherein, prior to step of cycling the punch through a forging stroke, the temperature of the workpiece is made to be in a range of from about 1200° F. to about 2200° F.

32. The method of claim 30, wherein, prior to step of cycling the punch through a forging stroke, the temperature of the workpiece is made to be in a range of from about 1800° F. to about 1900° F.

33. A method of near net warm forging a metal part comprising a base member having a top surface and a bottom surface, at least one top member extending from the top surface of the base member and at least one bottom member extending from the bottom surface of the base member, the width-to-maximum-height ratio of at least one of the at least one top member and the at least one bottom member being in a range of from about 1:1 to about 1:6, the method comprising the steps of:

providing a die and a punch comprising surfaces corresponding in shape to the top and bottom surfaces of the base member;

placing a workpiece in the die set; and cycling the punch through a forging stroke to forge the metal part from the workpiece.

34. The method of claim 33, wherein, prior to step of cycling the punch through a forging stroke, the temperature of the workpiece is made to be in a range of from about 1200° F. to about 2200° F.

35. The method of claim 33, wherein, prior to step of cycling the punch through a forging stroke, the temperature of the workpiece is made to be in a range of from about 1800° F. to about 1900° F.

36. A method of near net warm forging a metal part comprising a base member and at least one member extending orthogonal to the base member, the method comprising the steps of:

providing a segmented die and a punch comprising surfaces which form a cavity when the punch is in a first position corresponding in shape to the base member and the at least one member, wherein the segmented die and punch are designed and positioned such that the at least one member is formed by at least two segments of the die, and the surfaces of the die segments which form the side surfaces of the at least one member have a draft angle of less than 2°;

placing a workpiece in the die set; and cycling the punch through a forging stroke to forge the metal part from the workpiece.

37. The method of claim 36, wherein the segmented die further comprises at least one ejector pin slidably received in the segmented die, the method further comprising the step of actuating the at least one ejector pin to eject the unitary part.

38. The method of claim 36, wherein the workpiece has a substantially centralized mass.

39. The method of claim 36, wherein the workpiece is substantially cylindrical in shape, having a length-to-diameter ratio of from about 1:0.5 to about 1:1.5.

40. The method of claim 36, wherein the at least one member has side surfaces defined by the punch, and wherein the surfaces of the punch defining the side surfaces of the at least one member have a draft angle of less than 2°.

41. The method of claim 40, wherein the draft angles are substantially zero.

42. The method of claim 36, wherein, during the step of cycling the punch through the forging stroke, movement of material of the workpiece is such that all distal cavity surfaces are contacted by workpiece material at substantially the same time.

43. The method of claim 42, wherein, during the step of cycling the punch through the forging stroke, workpiece material flows in upward, downward, and lateral directions.

44. The method of claim 36, wherein the workpiece has a volume substantially equal to a volume of the metal part.

45. The method of claim 36, wherein the at least one member has a width-to-maximum-height ratio in a range of from about 1:1 to about 1:6.

46. The method of claim 36, wherein the at least one member comprises an outer surface and an inner surface substantially parallel to the outer surface.

47. The method of claim 36, wherein a transition between the base member and the at least one member has a radius of less than or equal to about 1 mm.

48. The method of claim 36, wherein the segmented die comprises a first die segment and a second die segment substantially symmetrical to the first die segment.

49. The method of claim 48, wherein the segmented die further comprises a third die segment positioned between the first and second die segments.

50. The method of claim 36, wherein, prior to step of cycling the punch through a forging stroke, the temperature of the workpiece is made to be in a range of from about 1200° F. to about 2200° F.

51. The method of claim 36, wherein, prior to step of cycling the punch through a forging stroke, the temperature of the workpiece is made to be in a range of from about 1800° F. to about 1900° F.

52. A metal part forged according to the method of claim 36.

* * * * *